US009598230B2

(12) United States Patent
Schmed et al.

(10) Patent No.: US 9,598,230 B2
(45) **Date of Patent: *Mar. 21, 2017**

(54) CARTRIDGE CONTAINING ONE SERVING OF COFFEE POWDER FOR PREPARING A COFFEE BEVERAGE

(75) Inventors: Arthur Schmed, Willen b. Wollerau (CH); Roberto Degli Esposti Venturi, Gaggio Montano (Bologna) (IT)

(73) Assignee: CAFFITALY SYSTEM S.P.A., Gaggio Montano (IT)

( * ) Notice: Subject to any disclaimer, the term of this patent is extended or adjusted under 35 U.S.C. 154(b) by 755 days.

This patent is subject to a terminal disclaimer.

(21) Appl. No.: 12/493,528

(22) Filed: Jun. 29, 2009

(65) Prior Publication Data

US 2010/0077928 A1 Apr. 1, 2010

Related U.S. Application Data

(63) Continuation-in-part of application No. 11/034,504, filed on Jan. 13, 2005, now Pat. No. 7,552,672.

(30) Foreign Application Priority Data

Jan. 14, 2004 (DE) ..... 10 2004 002 005

(51) Int. Cl.
*A47J 31/06* (2006.01)
*B65D 85/804* (2006.01)

(52) U.S. Cl.
CPC ..... *B65D 85/8043* (2013.01)

(58) Field of Classification Search
CPC ..... B65D 85/8043; A47J 31/44
USPC ..... 99/275, 279, 323, 295; 210/282, 314, 210/323.1; 206/0.5, 459.5; 426/77, 112, 426/115, 394, 431, 433
See application file for complete search history.

(56) References Cited

U.S. PATENT DOCUMENTS 2,224,409 A * 12/1940 Schleyer ..... 99/312
3,589,272 A 6/1971 Bouladon et al.
3,812,273 A 5/1974 Schmidt et al.
4,136,202 A 1/1979 Favre
(Continued)

FOREIGN PATENT DOCUMENTS

CH 605 293 A5 9/1978
DE 1924552 8/1970
(Continued)

*Primary Examiner* — Quang D Thanh
*Assistant Examiner* — Joseph Iskra
(74) *Attorney, Agent, or Firm* — Pearne & Gordon LLP

(57) ABSTRACT

A cartridge containing one serving of coffee powder for preparing a coffee beverage comprises a cartridge body having a cup-like shaped lower portion and a cover portion; the cup-like shaped lower portion having a bottom portion and a upper region; and a lower filter element located inside the cup-like shaped lower portion between the coffee powder and the bottom portion; in which the interior of the cup-like shaped lower portion of the cartridge is provided with engaging means, and in which the lower filter element is provided with a peripheral edge portion engaging the engaging means for clampingly fix the lower filter element to the cup-like shaped lower portion of the cartridge. In the preferred embodiments the engaging means are constituted by a groove provided in the interior or the exterior of the cup-shaped lower portion.

26 Claims, 4 Drawing Sheets

(56) References Cited

U.S. PATENT DOCUMENTS

| | | | | |
|---|---|---|---|---|
| 4,550,024 | A * | 10/1985 | le Granse | 426/77 |
| 4,806,369 | A | 2/1989 | Thompson | |
| 4,860,645 | A * | 8/1989 | van der Lijn et al. | 99/295 |
| 4,995,310 | A * | 2/1991 | van der Lijn et al. | 99/295 |
| 4,996,066 | A | 2/1991 | Love et al. | |
| 5,008,013 | A * | 4/1991 | Favre et al. | 210/482 |
| 5,108,768 | A * | 4/1992 | So | B65D 85/8043 206/519 |
| 5,227,188 | A * | 7/1993 | Leppla et al. | 426/595 |
| 5,243,164 | A | 9/1993 | Erickson et al. | |
| 5,347,916 | A | 9/1994 | Fond et al. | |
| 5,472,719 | A * | 12/1995 | Favre | 426/77 |
| 6,021,705 | A * | 2/2000 | Dijs | 99/295 |
| 6,383,375 | B1 * | 5/2002 | Zucholl | A47J 31/605 210/172.2 |
| 6,550,371 | B1 | 4/2003 | Del Bon et al. | |
| 6,740,345 | B2 | 5/2004 | Cai | |
| 6,832,542 | B2 | 12/2004 | Hu et al. | |
| 6,948,420 | B2 | 9/2005 | Kirschner et al. | |
| 7,552,672 | B2 | 6/2009 | Schmed | |
| 2001/0050002 | A1 * | 12/2001 | Bonanno | 99/275 |
| 2002/0078831 | A1 | 6/2002 | Cai | |
| 2003/0145736 | A1 | 8/2003 | Green | |
| 2003/0172813 | A1 * | 9/2003 | Schifferle | A47J 31/0673 99/275 |
| 2003/0222089 | A1 * | 12/2003 | Hale | 220/912 |
| 2005/0150390 | A1 | 7/2005 | Schifferle | |
| 2007/0148290 | A1 * | 6/2007 | Ternite | B65D 85/8043 426/90 |
| 2010/0077928 | A1 | 4/2010 | Schmed et al. | |

FOREIGN PATENT DOCUMENTS

| | | | |
|---|---|---|---|
| DE | 2004760 | A1 | 8/1970 |
| DE | 2326919 | | 12/1973 |
| DE | 2602832 | A1 | 7/1977 |
| DE | 69303555 | | 12/1996 |
| EP | 0211511 | | 2/1987 |
| EP | 0326685 | | 8/1989 |
| EP | 0337615 | | 10/1989 |
| EP | 0389141 | | 9/1990 |
| EP | 0398530 | A2 | 11/1990 |
| EP | 0455337 | A1 | 11/1991 |
| EP | 0554464 | | 8/1993 |
| EP | 0554469 | | 8/1993 |
| EP | 1101430 | A1 | 5/2001 |
| EP | 1140655 | A1 | 10/2001 |
| EP | 1247756 | | 10/2002 |
| EP | 1 364 605 | A1 | 11/2003 |
| EP | 1440640 | A2 | 7/2004 |
| EP | 1555219 | A1 | 7/2005 |
| FR | 2127329 | A5 | 10/1972 |
| FR | 2556323 | A1 | 6/1985 |
| GB | 2023086 | | 12/1979 |
| WO | 9317932 | | 9/1993 |
| WO | 9515143 | | 6/1995 |
| WO | 03/082065 | A1 | 10/2003 |

* cited by examiner

CARTRIDGE CONTAINING ONE SERVING OF COFFEE POWDER FOR PREPARING A COFFEE BEVERAGE

REFERENCE TO RELATED APPLICATION

This application is a continuation-in-part of application Ser. No. 11/034,504, entitled "CARTRIDGE CONTAINING ONE SERVING OF COFFEE POWDER FOR PREPARING A COFFEE BEVERAGE" filed on Jan. 13, 2005, which issued on Jun. 30, 2009, as U.S. Pat. No. 7,552,672, and which is owned by the assignee of the present application.

BACKGROUND

The present invention refers to a cartridge containing one serving of coffee powder for preparing a coffee beverage. Such cartridges are well known in the art in a plurality of embodiments, whereby particularly cartridges for preparing so-called espresso coffee beverage are in widespread use. The fundamental advantage of such cartridges may be seen in the fact that they are gas-tight, whereby the coffee powder is contained therein without oxygen that would impair the quality of the coffee powder during storage of the cartridge. Thus, the coffee powder contained in such cartridges keeps its freshness for a long time.

For brewing the coffee powder contained in the cartridge, either manually operated or semi-automatic as well as fully automatic coffee makers are used. Usually, in a manually operated coffee maker, the cartridge is inserted into a cartridge holder that in turn is inserted into the coffee maker. In the semi-automatic coffee makers, the cartridge is inserted into a cartridge retainer or directly into the brewing chamber of the machine, whereby the brewing chamber is manually closed by means of a central lever mechanism. In a fully automatic coffee maker, however, the cartridge is removed from a cartridge magazine and automatically inserted into the brewing chamber; after the brewing operation, the cartridge is removed from the brewing chamber and discarded into a trash receptacle without any intervention of the operator.

All these above mentioned species of coffee maker usually comprise a hollow so-called brewing spike provided with radial outlet openings for injecting brewing water into the cartridge that is also adapted to punch the bottom and the cover, respectively, of the cartridge. Also known are manually operated coffee makers in which the cartridge retainer is provided with a plurality of embossments located on an outlet grate; these embossments break open the cover of the cartridge as soon as brewing water is injected into the cartridge from the opposite side thereof and the cartridge is pressed against the embossments under the influence of the hydraulic overpressure created by the pressurized brewing water. During the subsequent brewing operation, the brewing water is injected into the cartridge by means of the brewing spike, with the result that is flows under pressure through the coffee powder contained in the cartridge and escapes from the cartridge through the opening created by the embossments.

Independent of the fact whether it is a manually operated coffee maker or a semi-automatic or a fully automatic machine, in many cases the coffee maker is designed and adapted to the cartridge so as to produce a coffee beverage having froth on its surface; that froth usually is considered as a characteristic of a good coffee beverage.

Even if great efforts have been taken to ensure that the prepared coffee beverage has durable froth on its surface, in certain countries the desire arises to prepare also conventional coffee in the sense of a filter coffee by means of these coffee makers. In place of the expression "filter coffee", also the expression "gentle coffee" is used.

In view of such a desire, coffee makers adapted to the cartridge so as to produce a coffee beverage without froth on its surface have been designed (as in co-pending application Ser. No. 11/034,504).

The U.S. Patent document 2003/0172813 discloses a cartridge of the kind referred to herein. It contains a substance extractable by means of water for preparing a beverage, preferably an espresso coffee. Thereby, a sieve-like member is disposed between the bottom of the cartridge and the substance and/or between the cover of the cartridge and the substance, provided with a plurality of axial apertures. The sieve-like member is provided with stampings directed towards the bottom of the cartridge and the cover of the cartridge, respectively, such that fluid channels are formed between the sieve-like member and the bottom of the cartridge, and the sieve-like member and the cover of the cartridge, respectively. In these channels, the brewing water can be distributed over the cross sectional area of the cartridge, and the prepared beverage can be collected in these channels, respectively. In order to prevent that the sieve-like member is punched upon piercing the cartridge, the sieve-like member comprises a central recess directed towards the interior of the cartridge into which the piercing member can extend once the cover or the bottom of the cartridge have been pierced. Even if such a cartridge is well suitable for preparing espresso coffee, it can hardly be used for preparing normal filter coffee, since the cartridge presents a high flow resistance to the brewing water flowing there trough; the result is a formation of froth.

Such known kind of cartridge suffers the drawback that the lower filter can move from its nominal position under the effect of the cartridge's movements, so that coffee powder can flow out together with the beverage by passing between the filter and the lateral wall of the cartridge itself.

The patent document EP 0,326,685 discloses a container, called a brewing chamber, adapted to be disposed of after use, which is collapsible and to the bottom of which a filter bag containing ground coffee or tea is glued. Preferably, the container is made of paper, carton or a similar material. The bottom of the container is provided with an outlet opening located below the filter bag through which the prepared beverage can flow out. In a preferred embodiment of the container, the outlet opening is covered at the outside with a removable foil. Such a container may be usable in a conventional filter coffee machine, but not in an espresso coffee machine.

SUMMARY OF THE INVENTION

It is one object of the present invention to provide a cartridge containing one serving of coffee powder for preparing a coffee beverage comprising a cup-like shaped portion in which a filter is located, and in which the filter is fixed in the interior of the cartridge.

In particular it is an object of the present invention to develop cartridges for the preparation of any kind of coffee (espresso, filter coffee, . . . ), in which the filter can not move from its nominal position so that to prevent any undesired flow out of the coffee powder together with the beverage.

To meet the above-cited and other objects, the present invention provides a cartridge containing one serving of coffee powder for preparing a coffee beverage, comprising a cartridge body having a cup-like shaped lower portion and a cover portion, wherein the cup-like shaped lower portion has a bottom portion and an upper region. The cartridge further comprises a lower filter element located inside the cup-like shaped lower portion between the coffee powder and the bottom portion, and the cup-like shaped lower portion is provided with an annular groove in which a peripheral edge portion of the filter engages for clampingly fix the lower filter element to the cup-like shaped lower portion of the cartridge. More in detail, the filter element is provided with a circumferential edge portion which is provided with a circumferential annular projection engaging the groove to clampingly fix the filter element in the interior of the cartridge. Furthermore, the groove can be provided both in the interior and in the exterior of the capsule.

In an alternative embodiment, the interior of the cup-like shaped lower portion of the cartridge is provided with engaging means, and the peripheral edge portion engages the engaging means for clampingly fix the lower filter element to the cup-like shaped lower portion. Such engaging means that, in the illustrated embodiments, is defined by the groove, can assume every shape or configuration adapted to clampingly fix the filter. For example they can be constituted by one or more elements projecting inwardly and acting as the groove in the embodiments of FIGS. 6 and 8.

In the following, the present invention is disclosed with reference to a cartridge containing one serving of coffee powder for preparing a coffee beverage, comprising a cartridge body having a bottom portion and a cover portion, the bottom portion of the cartridge body having a passage covered by a gas-tight foil member, and a filter element located inside the cartridge body between the coffee powder and the passage in the bottom portion of the cartridge body. Such cartridge is designed for the production of filter coffee that is coffee without froth on its surface.

In fact, by providing at least the bottom portion of the cartridge with a passage constituted by an aperture, adapted to avoid a hydraulic pressure build-up in the interior of the cartridge during brewing and extracting the coffee powder, the fundamental prerequisite is realized to use such a cartridge in a conventional espresso machine for preparing a coffee beverage corresponding in appearance and taste to a normal filter coffee. The passage ensures that the pressurized brewing water fed into the cartridge cannot create a substantial pressure build-up in the interior of the cartridge. Thus, the brewing water can flow through the cartridge and, thereby, through the coffee powder contained therein without any substantial resistance, thereby avoiding the formation of froth.

As said above, in order to prevent the coffee powder contained in the cartridge from escaping the cartridge through the aforementioned passage and from being flushed out by the brewing water, the filter element is arranged between the passage and the coffee powder contained in the cartridge. In order to ensure that the coffee powder contained in the cartridge keeps well during an extended period of time in spite of the passage provided in the cartridge, the passage is covered by a gas-tight foil. The latter one is either manually removable or designed such that it can be easily pierced by a punching member.

In any case, the present invention can be applied to cartridges for the production of any kind of coffee.

BRIEF DESCRIPTION OF THE DRAWINGS

In the following, embodiments of the cartridge according to the invention will be further described, with reference to the accompanying drawings, in which.

DETAILED DESCRIPTION OF THE EMBODIMENTS

Figure 1:
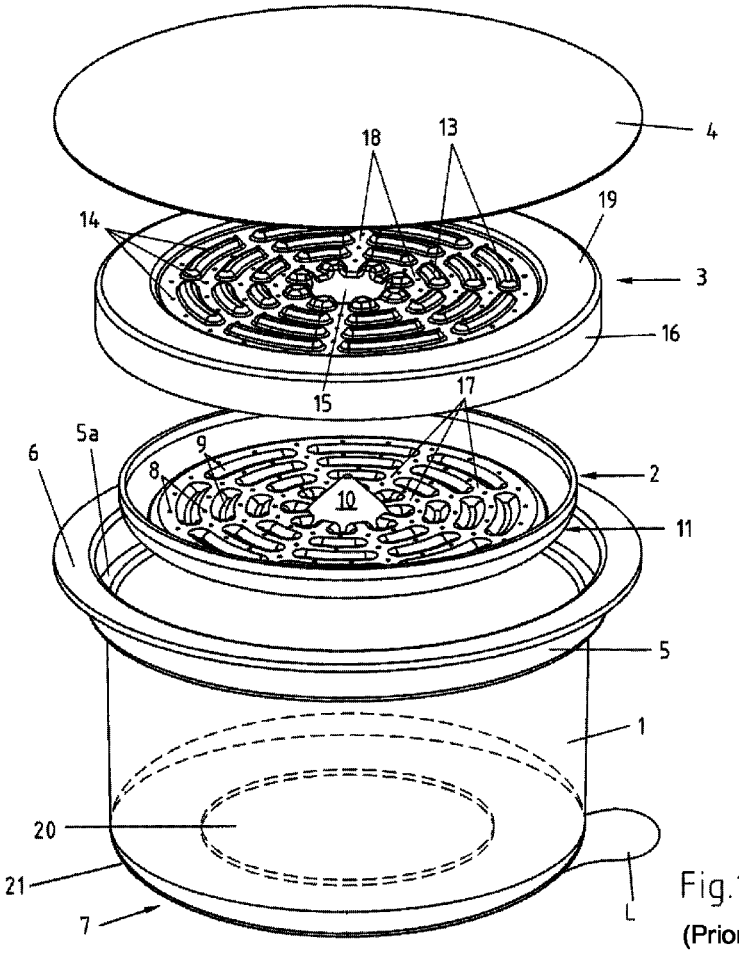
Fig.1 (Prior Art)
FIG. 1 shows the elements of a coffee powder cartridge not embodying the invention in an exploded view.
Figure 2:
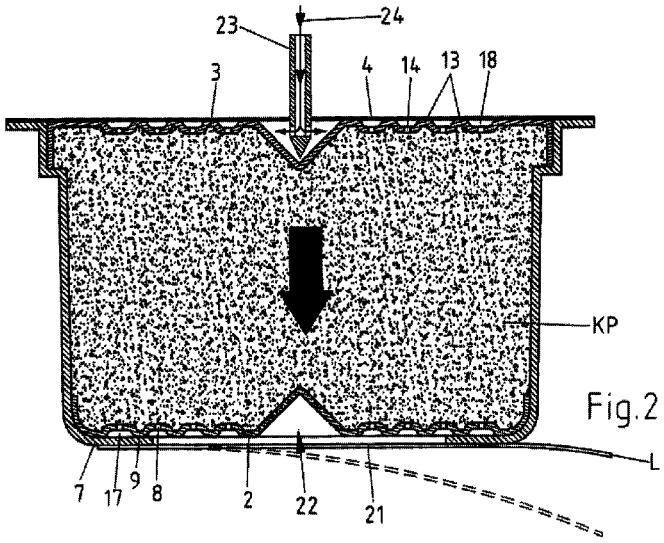
Fig.2 (Prior Art)
FIG. 2 shows a longitudinal sectional view of the embodiment of a coffee powder cartridge not embodying the invention.

The coffee powder cartridge according to the present invention as well as the one according to FIGS. 1 and 2, comprises a cup-like shaped lower portion 1, a lower filter element 2, an upper distribution member 3 and a cartridge cover member 4. The coffee powder to be received in the lower portion 1 of the cartridge between the filter element 2 and the distribution member 3 is not shown in FIGS. 1, and 4-8. The filter element 2 and the distribution member 3 are dimensionally stable and have essentially disc-like shape; preferably, they are manufactured by a deep drawing process. The reference numerals of corresponding parts and elements in FIGS. 3-8 are the same as used in FIGS. 1 and 2, but with the letter "a" added.

Figure 3:
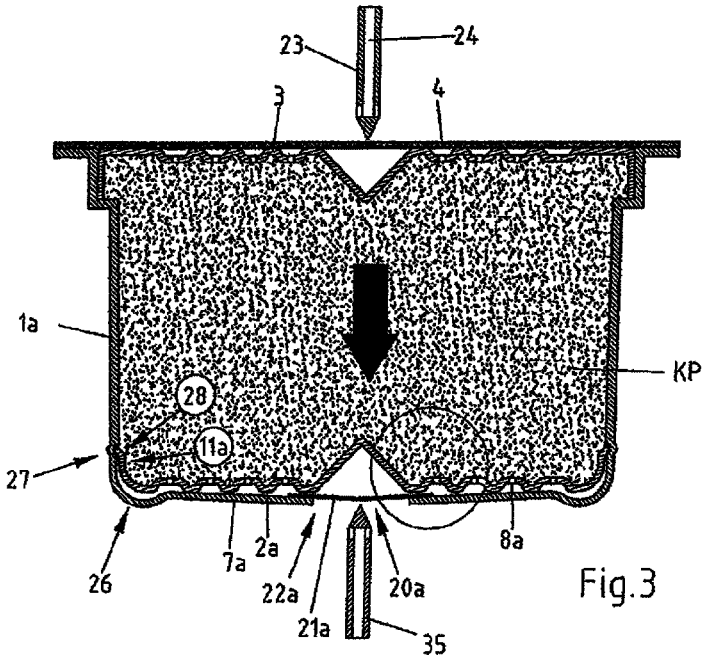
FIG. 3 shows a longitudinal sectional view of a coffee powder cartridge according to the invention for the production of filter coffee.
Figure 4:
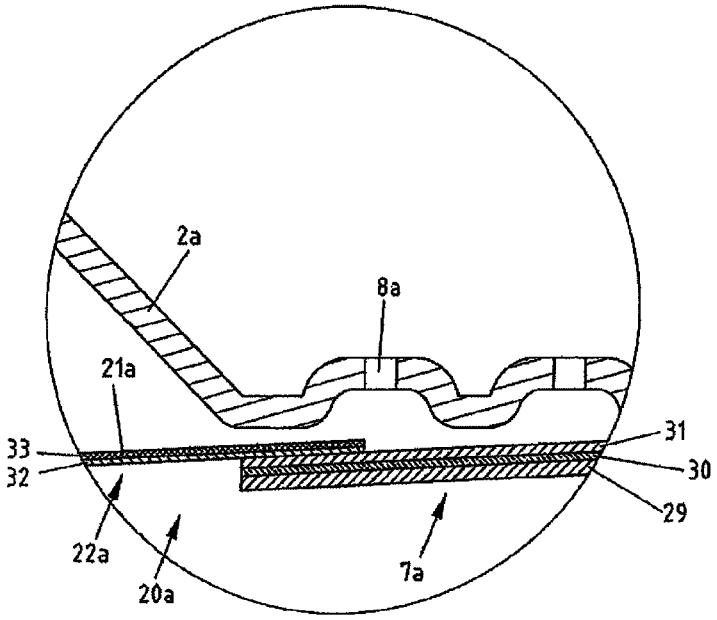
FIG. 4 shows an enlarged portion of FIG. 3.

FIGS. 3 and 4 show a longitudinal sectional view of a first embodiment of a cartridge according to the present invention, filled with coffee powder KP. FIGS. 5-7 and 6-8, respectively, show a longitudinal sectional view of some parts of a second and third embodiment of a cartridge according to the present invention.

Finally, while, in the embodiments of FIGS. 1-4 the bottom of the cup-like shaped portion is provided with an aperture, the ones of FIGS. 5-8 all represent cartridges in which the bottom of the cup-like shaped lower portion is without any aperture. Further, apart from the subject-matter of the present invention (which is not present in FIGS. 1 and 2) and some other minor differences, the embodiment of FIGS. 1-2 mainly correspond to the ones of FIGS. 3-8.

The upper region of the lower portion 1 of the cartridge, slightly conically widening towards it top, is provided with a enlarged portion 5, establishing an annular shoulder 5*a* at the inside of the cartridge, serving for supporting the upper distribution member 3. At the top, the cup-shaped portion 1 of the cartridge comprises a circumferential edge portion 6 to which a cover 4 is fixed, preferably welded. As schematically indicated in FIG. 1 by dashed lines, in the embodiments of FIGS. 1-4 the bottom 7 of the cup-shaped portion 1 of the cartridge is provided with a round aperture 20 for forming a passage 22, which is covered by a foil 21 (the aperture has a different dimension in FIGS. 1-2 and 3-4). In FIGS. 1 and 2, the foil 21 comprises a flap L, laterally protruding from the cup-shaped portion 1 of the cartridge, facilitating a manual removal of the foil 21. The cup-shaped portion 1 of the cartridge, the cover 4 as well as the foil 21 consist of a gas-tight multi-layer composite material, whereby the lower portion 1, as compared to the cover 4 and the foil 21, is relatively stiff, dimensionally stable, elastic and ductile. As regard the embodiment of FIGS. 3-4, the passage 22*a* constituted by the aperture 20*a* is not covered by a foil from the outside of the cartridge that is manually removable, but by a foil 21*a* located at the inside of the bottom 7*a* of the cartridge and covering the passage 22*a* itself.

After the aperture 20, 20*a* having been covered by the foil 21, 21*a*, and after the cover having been welded to the circumferential edge portion 6 of the cup-shaped portion 1 of the cartridge, the cartridge and, thereby, its content are air-tightly sealed. All these foil materials used for manufacturing the lower portion 1 of the cartridge, the cover 4 and the foil 21, 21*a* preferably comprise at least one gas-tight layer as well as a layer of a thermoplastic polymer. Layers of thermoplastic polymer are easily welded to each other, for instance under the influence of heat or ultrasound.

The filter element 2, 2*a*, having essentially dish-like shape, is provided with a circumferential edge portion 11, 11*a* and, in the illustrated embodiments, comprises a plurality of stampings 9 having essentially the shape of annular segments and protruding above the bottom of the filter element 2, 2*a* downwards. Once the filter element 2, 2*a* is inserted into the cup-shaped portion 1, the stampings 9 rest on the bottom of the portion 1 of the cartridge. Thus, between the stampings 9 and the bottom of the portion 1 of the cartridge, collection channels 17 are formed that extend, with reference to a central vertical axis, radially outwards and circularly around the central axis. In the areas between the stampings 9, in the region of the channels 17, the filter element 2, 2*a* is provided with a plurality of apertures 8, 8*a*. In the center of the filter element 2, 2*a*, a central, cone-shaped recess 10 is provided that is directed towards the interior of the cartridge.

The upper distribution member 3 also comprises a plurality of stampings 13 having essentially the shape of annular segments and protruding above the top of the distribution member 3 upwards. Between the stampings 13, at the top of the distribution member 3, fluid channels 18 are formed that extend, with reference to a central vertical axis, radially outwards and circularly around the central axis. In the areas between the stampings 13, in the region of the channels 18, the distribution member 3 is provided with a plurality of apertures 14. In the center of the distribution member 3, a central, cone-shaped recess 15 is provided that is directed towards the interior of the cartridge. Along its periphery, the distribution member 3 is provided with an annular surface portion 19, slightly elevated with respect to the fluid channels 18, and being essentially flush with the stampings 13. The edge of the annular surface portion 19 comprises an annular portion 16 extending downwards from the surface portion 19.

Upon inserting the upper distribution member 3 into the cup-shaped lower portion 1 of the cartridge, the distribution member 3 rests with its portion 16 on the shoulder 5*a* of the enlarged portion 5 of the cartridge portion 1. During feeding brewing water into the cartridge for preparing a coffee beverage, the distribution member 3 particularly serves for evenly distributing the brewing water over the entire cross section of the cartridge, while the lower filter element 2, 2*a* particularly prevents any coffee powder particles from escaping from the cartridge. Additionally, the upper distribution member 3 also serves as a filter, while the lower filter element 2, 2*a* also serves to collect and centrally discharge the prepared coffee beverage.

In order to arrive at an optimal distribution of the brewing water over the entire cross sectional area of the cartridge and, thereby, at an even soaking of the coffee powder contained in the cartridge, both the apertures 14 provided in the distribution member 3 and the apertures 8, 8*a* in the filter element 2, 2*a* are evenly distributed over the respective surface of the member 3 and element 2, 2*a*, respectively. The entire summed cross sectional area of the apertures 14 provided in the distribution member 3 amounts to at least three percent (3%), preferably to five percent (5%) of the total cartridge cross sectional area. The same relationship is also true for the lower filter element 2, 2*a*. By this design, it is ensured that the brewing water flows through the distribution member 3 into the interior of the cartridge without any substantial resistance, and that the prepared coffee beverage can flow through the lower filter element 2, 2*a* out of the cartridge without any substantial resistance, as well. Moreover, the aperture 20 in the bottom 7, 7*a* of the cartridge ensures that neither at the beginning nor during the brewing operation a hydraulic pressure build-up can take place. By this design, the formation of froth in the finished coffee beverage can be reliably avoided.

Nevertheless, the size of the apertures 8, 8*a*, 14 in the filter and distribution elements 2, 2*a*, 3 should not be chosen so large that coffee powder can escape from the cartridge. To this end, the diameter of a single aperture 8, 8*a*, 14 is made somewhat smaller than the statistic mean value of the diameter of a single particle of the coffee powder. In order not to confront the brewing water with a high flow resistance when it flows through the coffee powder contained in the cartridge, the coffee powder is relatively coarsely ground. The arithmetic mean value of one particle of the coffee powder amounts to between 400 and 600 μm in the present example.

Preferably, the foil 21, 21*a* has a color that is different from the color of the cartridge. The color of the foil 21, 21*a* can be selected, for example, to determine the content of the cartridge. In other words, depending on the amount of coffee contained in the cartridge, the blend of the coffee, or the degree of grinding, a different color is selected for the foil.

FIG. 2 shows a longitudinal sectional view of the cartridge of FIG. 1, whereby the cartridge is filled with coffee powder KP. The coffee powder KP is enclosed between the lower filter element 2 and the upper distribution member 3 in the cartridge. As can be seen from FIG. 2, fluid channels 17 are formed by the stampings 9 of the lower filter element 2 resting on the bottom 7 of the cup-shaped lower portion 1 of the cartridge into which the prepared coffee beverage can flow through the apertures 8 provided in the lower filter element 2. Similarly, by the stampings 13 provided in the distribution member 3, fluid channels 18 are formed between the distribution member 3 and the cover 4 of the cartridge, by means of which the brewing water is evenly distributed on top of the coffee powder to flow through the apertures 14 for soaking the coffee powder. Due to the fact that both the distribution member 3 and the filter element 2 are dimensionally stable, the channels 17, 18 are preserved even if outer forces affect the cover 4 and the bottom 7 of the cartridge. It is understood that the foil 21 is removed from the bottom 7 of the cartridge prior to inserting the latter one into the coffee machine, as is indicated in FIG. 2 by broken lines.

Once the foil 21 is removed, the cartridge can be inserted into the brewing chamber of a coffee machine (not shown).

For punching the cartridge, a punching means, e.g. in the form of a piercing sting 23, is lowered towards the cover 4 of the cartridge and pierces the latter one. Thereby, the piercing sting 23 moves through the cover 4 into the recess 15 provided in the distribution member 3, thus avoiding any damage to the distribution member 3. For feeding brewing water 24 into the interior of the cartridge, the piercing sting 23 is provided with a central bore, opening into radial outlet openings.

In the present case, it is assumed that the brewing water 24 flows through the cartridge from its top to its bottom. By means of the fluid channels 18, the brewing water is evenly distributed over the entire cross section of the cartridge. Through the apertures 14 provided in the upper distribution member 3, the brewing water enters the interior of the cartridge to flow through the coffee powder. Through the apertures 8, 8*a* in the lower filter element 2, 2*a*, the prepared coffee beverage enters the space below the filter element 2, 2*a* and escapes from the cartridge through the passage 22, 22*a* formed by the aperture 20, 20*a*; therefrom, it is led by not further shown means to a coffee beverage outlet of the coffee machine.

By the provision of the previously described distribution member 3 and filter element 2, 2*a* it is ensured that the coffee particles contained in the cartridge are homogenously soaked, resulting in an optimal extraction of the entire coffee powder. The stampings 9, 13 are distributed such that the respective element 2, 3 rests in a two-dimensional way on the bottom 7 of the cartridge and on the cover 4 of the cartridge, respectively. Thereby, it is ensured that the fluid channels 17, 18 maintain their shape between element 2, 2*a* and bottom 7, and member 3 and cover 4, respectively, even if external forces affect the cartridge.

The diameter of the apertures 8, 14 provided in the distribution member 3 and the filter element 2, 2*a*, respectively, is preferably smaller than the statistic diameter of a single particle of the coffee powder, preferably smaller than $x-\sigma$, whereby x is the arithmetic mean value of the diameter and $\sigma$ is the standard deviation. Thereby, it is ensured that essentially no coffee particles can escape from the cartridge, independent of the size of the opening that is punched into the cover 4 by the piercing sting 23.

In the embodiment of FIGS. 3 and 4, the foil 21*a* is punched by a piercing sting 35 before the brewing operation starts. In the embodiment of FIGS. 3, 4, 5 and 7, the cup-like shaped lower portion 1*a* of the cartridge is provided with a slightly outwardly domed bottom 7*a*, surrounded along its outer edge by a circumferential annular edge portion 26. The diameter of the aperture 20*a* provided in the bottom 7*a* of the cartridge is smaller than the corresponding aperture 20 in the embodiment of FIGS. 1 and 2. The foil 21*a* for covering the aperture 20*a* is located in the interior of the cartridge between the filter element 2*a* and the bottom 7*a* of the cartridge.

While the cup-like shaped lower portion 1*a* of the cartridge is relatively, stiff, dimensionally stable, elastic and ductile, the foil 21*a* is, as compared thereto, thinner and comprises a lower elasticity, ductility and tear strength. Thereby, it is ensured that the foil 21*a* readily tears apart under the influence of the piercing sting 35. In order to keep the foil 21*a* relatively thin, it is made of a two layer material. The combination of a layer of aluminum and a layer of thermoplastic polymer has been proven to be particularly advantageous. As a thermoplastic polymer, particularly suitable are polypropylene or polyethylene. By providing a layer of aluminum, a very good gas-tight sealing can be achieved, while the thermoplastic polymer layer enables a welding of the foil to the bottom 7*a* of the cartridge.

As regard the embodiments of FIGS. 5-8 they differ from the ones of FIGS. 1-4 in that the bottom of the cup-like shaped lower portion 1*a* is devoid of any aperture. In those embodiments, the opening of the cartridge is ensured, in a known way, by means of a piercing sting which directly pierces the bottom of the lower portion 1*a*.

Figure 5:
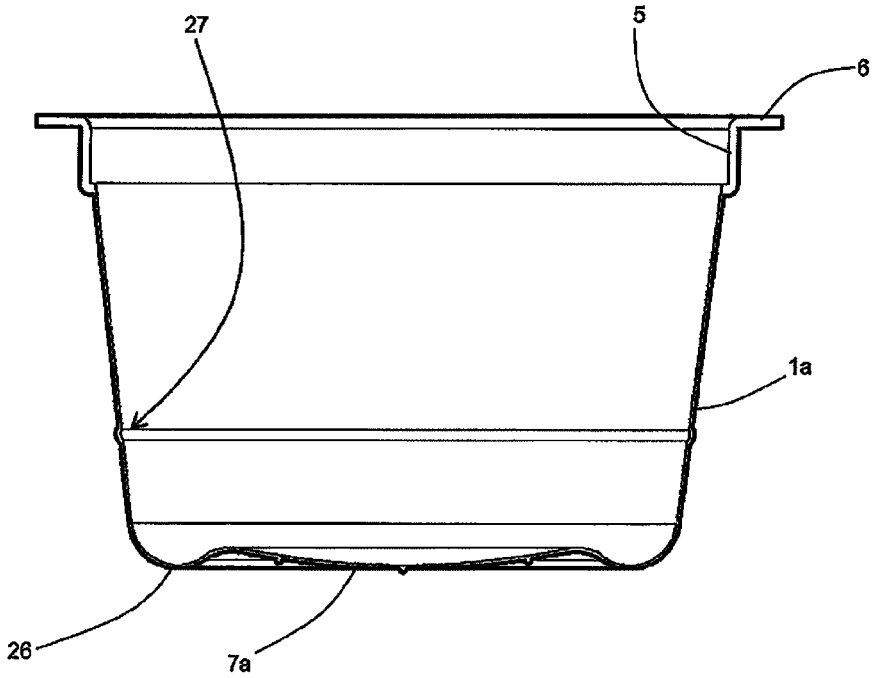
FIG. 5 shows a longitudinal sectional view of the cup-like shaped lower portion of a cartridge according to a second embodiment of the invention for the production of espresso coffee.
Figure 6:
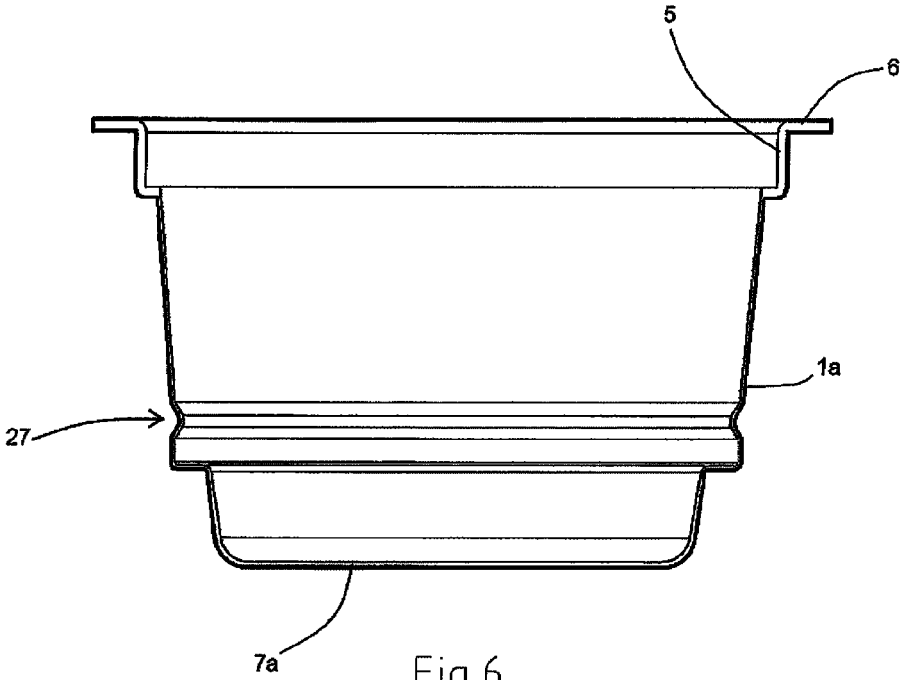
FIG. 6 shows a longitudinal sectional view of the cup-like shaped lower portion of a cartridge according to a third embodiment of the invention for the production of espresso coffee.
Figure 7:
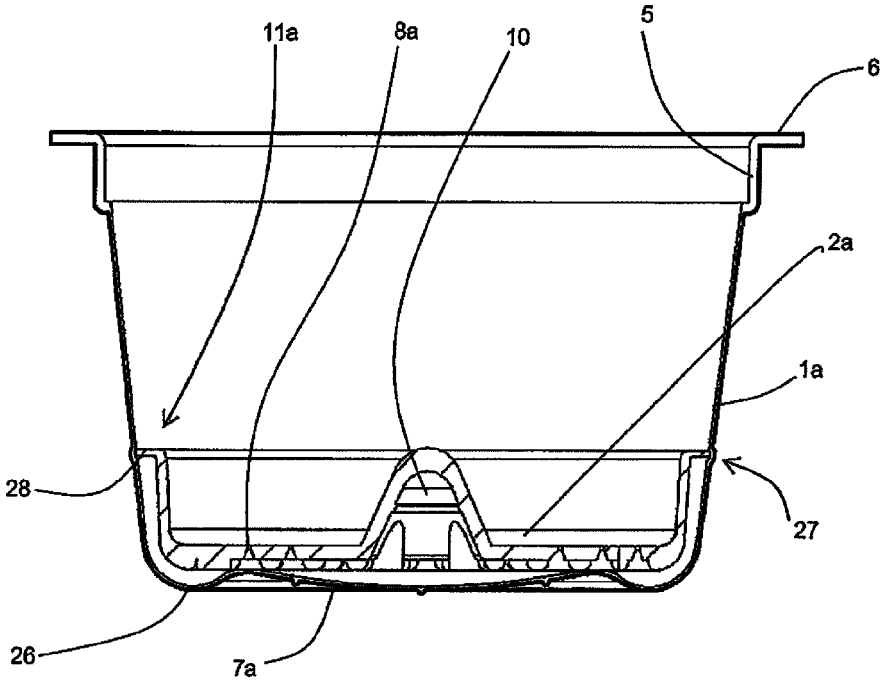
FIG. 7 shows a longitudinal sectional view of the cup-like shaped lower portion of FIG. 5 in which a lower filter has been inserted.
Figure 8:
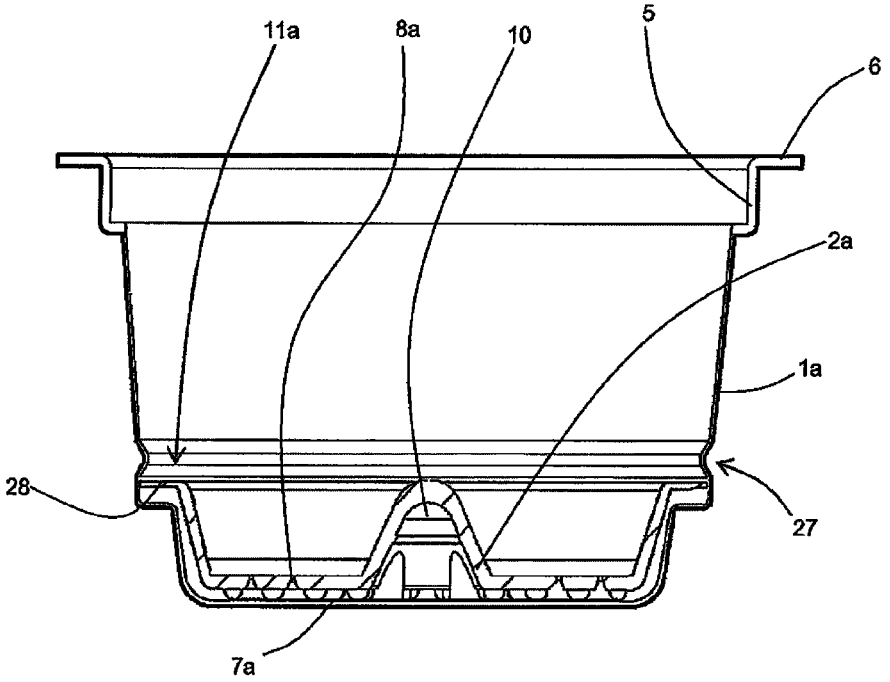
FIG. 8 shows a longitudinal sectional view of the cup-like shaped lower portion of FIG. 6 in which a lower filter has been inserted.

Furthermore, the embodiment of FIGS. 5 and 7 mainly differs from the ones of FIGS. 3, 4, 6 and 8 in the way the lower filter 2*a* is fixed to the cup-shaped lower portion 1*a*.

In fact, according to the present invention, the cup-like shaped lower portion 1*a* of the cartridge is provided with a circumferential groove 27, while the edge 11*a* of the filter element 2*a* (and, preferably, a circumferential annular projection 28 which the edge 11*a* is provided of) engages the groove 27 to clampingly fix the filter element 2*a* in the interior of the cartridge. According to the embodiment of FIGS. 3, 4, 5 and 7, the circumferential groove 27 is located at the inside of the lower portion 1*a* and projects outwardly, the edge 11*a* of the filter entering the groove 27 for fixing the filter. According to the embodiment of FIGS. 6 and 8, the circumferential groove 27 is located at the outside of the lower portion 1*a* and projects inwardly. In that case the edge 11*a* is positioned below the projecting groove 27 (that is it is between the groove 27 and the bottom of the cup-shaped lower portion 1*a*) and has an outer diameter greater than the inner diameter of the groove 28 so that the movement of the filter 2*a* towards the upper region of the cup-shaped lower portion is prevented. FIG. 4 shows an enlarged portion of FIG. 3, particularly a portion of the bottom 7*a* of the cartridge, together with the aperture 20*a* provided therein and the foil 21*a* covering the aperture 20*a*. In this illustration, it can be clearly seen that both the lower portion 1*a* of the cartridge and the foil 21*a* comprise multiple layers. While the lower portion 1*a* and, thereby, the bottom 7*a* of the cartridge both consist of a three-layer composite material, the foil 21*a* comprises two layers. In the material constituting the lower portion 1*a* of the cartridge, the two outer layers 29 and 31 consist of a thermoplastic polymer, while the intermediate layer 30 consists of a gas-tight foil material, for example EVOH (ethylene vinyl alcohol). The lower layer 32 of the foil 21*a*, facing the cartridge bottom 7*a*, consists of a thermoplastic polymer as well, while the upper layer 33 facing the interior of the cartridge consists of aluminum. Since the layers 31, 32 of the cartridge bottom 7*a* and the foil 21*a*, respectively, facing each other, both consist of a thermoplastic polymer, these two layers 31, 32 can easily be welded to each other. The foil 21*a* has, as compared to the composite material of the cup-like shaped lower portion 1*a* of the cartridge, a relatively low ductility, elasticity and tear strength.

The foil 21*a*, visible from the outside through the aperture 20*a*, preferably has another color than the cartridge itself. After the foil 21*a* and the cover 4 having been welded to the lower portion 1*a* of the cartridge, the cartridge and, thereby, its content are air-tightly sealed.

Due to the fact that the foil 21*a* is relatively thin and does not exhibit a high ductility, elasticity or tear strength, it can easily be punched by the piercing sting. Thereby, it is ensured that in a fully automatic espresso coffee machine both conventional coffee powder cartridges (as the ones of FIGS. 5-8), suitable for preparing an espresso coffee having froth on its top, and coffee powder cartridges as hereinbefore discussed with regard to FIGS. 1-4, suitable for preparing a normal coffee without froth, can be used. In any case, the foil is designed such that it is punched by a piercing sting even at a relatively low force, while a conventional, one-piece coffee powder cartridge, and particularly its bottom, are designed such that the bottom, in a first phase, is elastically deformed and pierced only under the influence of the pressure of the brewing medium. By such elastic behavior of the bottom of a conventional cartridge, it is ensured that an initial pre-brewing phase takes place. To this end, brewing water is fed into the interior of the cartridge that is still closed at its bottom, thus creating an overpressure in the interior of the cartridge to soak and, if appropriate, swell the coffee powder, before the bottom of the cartridge is punched, whereby the prepared coffee beverage escapes from the cartridge under formation of froth.

Whenever, in the foregoing, the expression "espresso coffee machine" has been used, it was to designate generally a coffee machine, having a brewing chamber adapted to receive the coffee powder cartridge and a pump for feeding pressurized water into the cartridge, independently of the fact whether the espresso coffee machine is used for preparing a "small" espresso coffee or a "larger" coffee. Anyway, coffee beverages prepared with an espresso coffee machine have been characterized by the fact that they had froth on the surface. However, by means of the coffee powder cartridge according to the enclosed FIGS. 1-4, it is also possible to prepare a coffee beverage that does not exhibit any froth and has a taste coming very close to a filter coffee beverage, even using a conventional espresso coffee machine designed for preparing espresso coffee using special espresso cartridges.

What is claimed is:

1. A single cartridge containing one serving of coffee powder for preparing a coffee beverage, comprising a cartridge body and a lower filter element, the cartridge body having a cup-like shaped lower portion and a cover, the cup-like shaped lower portion having a bottom portion, an open top, a lateral wall and an upper region defined by the lateral wall, the open top being opposite the bottom portion, the cover being fixed to the open top and covering the open top, the cup-like shaped lower portion containing the coffee powder, the lower filter element being located within an interior volume of the cup-like shaped lower portion, the lower filter element having a peripheral edge portion and being located between the coffee powder and the bottom portion, the interior of the cup-like shaped lower portion being provided with an annular groove formed in the lateral wall, the annular groove being located at the inside of the cup-like shaped lower portion and providing a corresponding projection projecting outwardly, wherein the portion of the lateral wall which defines the annular groove also defines the corresponding projection projecting outwardly, the annular groove engaging the peripheral edge portion of the lower filter element and clampingly fixing the lower filter element to the cup-like shaped lower portion and preventing movement of the lower filter element towards the cover.

2. The cartridge according to claim 1, wherein said peripheral edge portion is provided with a circumferential annular projection which engages the annular groove.

3. The cartridge according to claim 2, wherein said circumferential annular projection enters the annular groove.

4. A single cartridge containing one serving of coffee powder for preparing a coffee beverage, comprising a cartridge body and a lower filter element, the cartridge body having a cup-like shaped lower portion and a cover, the cup-like shaped lower portion having a bottom portion, an open top, a lateral wall and an upper region defined by the lateral wall, the open top being opposite the bottom portion, the cover being fixed to the open top and covering the open top, the cup-like shaped lower portion containing the coffee powder, the lower filter element being located within an interior volume of the cup-like shaped lower portion, the lower filter element having a peripheral edge portion and being located between the coffee powder and the bottom portion, in which the lateral wall of said cup-like shaped lower portion of said cartridge is provided with an annular groove which is located at the outside of the cup-like shaped lower portion and provides a corresponding projection which projects inwardly, wherein the portion of the lateral wall which defines the annular groove also defines the corresponding projection which projects inwardly, said peripheral edge portion engaging the inward projection of the annular groove so that the lower filter element is clampingly fixed to the cup-like shaped lower portion, whereby a movement of the lower filter element towards the cover is prevented.

5. The cartridge according to claim 4, wherein said peripheral edge portion is provided with a circumferential annular projection which engages the inward projection of the annular groove.

6. The cartridge according to claim 1 in which said lower filter element is dimensionally stable and comprises a plurality of apertures.

7. The cartridge according to claim 6 in which the total cross sectional area of all said apertures in said lower filter element amounts to at least three percent (3%) of the mean cross sectional area of said cartridge body, such that the prepared coffee beverage can flow through said lower filter element without substantial resistance to said passage and out of the cartridge.

8. The cartridge according to claim 1 in which said lower filter element is provided with a plurality of channels for collecting and discharging the coffee beverage escaping from the cartridge.

9. The cartridge according to claim 8 in which said lower filter element comprises stampings directed towards the interior of the cartridge for constituting said channels, and a plurality of apertures, whereby said apertures are located in said channels.

10. The cartridge according to claim 1 in which said lower filter element comprises at least one recess directed towards the interior of the cartridge.

11. The cartridge according to claim 6 in which the statistic mean value of the diameter of a single coffee powder particle amounts to between 400 and 600 μm, and in which the diameter of the apertures provided in the lower filter element is smaller than the statistic mean diameter of a single coffee powder particle.

12. The cartridge according to claim 1 in which said bottom portion of said cup-like shaped lower portion has a passage and a gas-tight foil member covers said passage.

13. The cartridge according to claim 12 in which said foil member is located at an inside of the cartridge body between said lower filter element and said bottom portion.

14. The cartridge according to claim 12 in which said foil member is attached to an outside of said bottom portion and is manually removable.

15. The cartridge according to claim 7, wherein the total cross sectional area of all said apertures in said lower filter element amounts to at least five percent (5%) of the mean cross sectional area of said cartridge body.

16. The cartridge of claim 1, wherein the lower filter element has a bottom portion (a) located lower than the peripheral edge portion and (b) extending towards the bottom portion of the cup-like shaped lower portion.

17. The cartridge of claim 1, wherein the annular groove is located in an intermediate position between the open top and the bottom portion.

18. The cartridge of claim 1, wherein the coffee powder fills a chamber which is delimited by the lateral wall and the lower filter element, the coffee powder being in contact with the lateral wall on a region between the open top and the annular groove.

19. The cartridge of claim 1, wherein the lower filter element is dimensionally stable and has essentially a disc-like shape.

20. The cartridge of claim 4, wherein the coffee powder fills a chamber which is delimited by the lateral wall and the lower filter element, the coffee powder being in contact with the lateral wall on a region between the cover and the inward projection of the annular groove.

21. The cartridge of claim 4, wherein the lower filter element is dimensionally stable and has essentially a disc-like shape.

22. The cartridge according to claim 4 in which said lower filter element is dimensionally stable and comprises a plurality of apertures, the total cross sectional area of all said apertures in said lower filter element amounts to at least three percent (3%) of the mean cross sectional area of said cartridge body, such that the prepared coffee beverage can flow through said lower filter element without substantial resistance to said passage and out of the cartridge.

23. The cartridge according to claim 4 in which said bottom portion of said cup-like shaped lower portion has a passage and a gas-tight foil member covers said passage.

24. The cartridge of claim 4, wherein the lower filter element has a bottom portion (a) located lower than the peripheral edge portion and (b) extending towards the bottom portion of the cup-like shaped lower portion.

25. The cartridge according to claim 4 in which said lower filter element comprises at least one recess directed towards the interior of the cartridge.

26. The cartridge according to claim 4 in which said lower filter element is provided with a plurality of channels for collecting and discharging the coffee beverage escaping from the cartridge, said lower filter element comprising stampings directed towards the interior of the cartridge for constituting said channels, and a plurality of apertures, whereby said apertures are located in said channels.

* * * * *